US006558472B2

(12) United States Patent
Tung

(10) Patent No.: US 6,558,472 B2
(45) Date of Patent: May 6, 2003

(54) CLEANING DEVICE FOR THE ANUS

(76) Inventor: Steven Tung, 1645 Green Castle Ave. #F, Rolling Heights, CA (US) 91748

( * ) Notice: Subject to any disclaimer, the term of this patent is extended or adjusted under 35 U.S.C. 154(b) by 0 days.

(21) Appl. No.: 09/829,322

(22) Filed: Apr. 9, 2001

(65) Prior Publication Data

US 2002/0144711 A1 Oct. 10, 2002

(51) Int. Cl.[7] ..... B08B 7/00

(52) U.S. Cl. ..... 134/6; 15/210.1; 604/335; 604/385.19; 604/385.201; 604/348; 604/284; 4/449; 4/450; 4/679

(58) Field of Search ..... 134/6; 15/210.1; 604/355, 385.19, 385.201, 348, 284; 4/449, 450, 479

(56) References Cited

FOREIGN PATENT DOCUMENTS

| | | | |
|---|---|---|---|
| GB | 2351981 | * | 1/2001 |
| JP | 08215230 | * | 8/1996 |
| JP | 2001061365 | * | 3/2001 |

* cited by examiner

*Primary Examiner*—Randy Gulakowski
*Assistant Examiner*—M. Kornakov
(74) *Attorney, Agent, or Firm*—Goldstein & Lavas, P.C.

(57) ABSTRACT

A cleaning device for the anus including a cylindrical portion comprised of a flexible material. The cylindrical portion has an open upper end, a closed lower end, and a cylindrical side wall therebetween. The closed lower end is concave defining a central alignment point.

1 Claim, 2 Drawing Sheets

CLEANING DEVICE FOR THE ANUS

BACKGROUND OF THE INVENTION

The present invention relates to a cleaning device for the anus and more particularly pertains to allowing a person to effectively clean themselves after a bowel movement.

The use of personal hygiene devices is known in the prior art. More specifically, personal hygiene devices heretofore devised and utilized for the purpose of facilitating personal hygiene are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,875,512 to Lathan discloses a device capable of cleaning waste from the anal area of a user comprised of a handle with an ejection assembly. U.S. Pat. Nos. 5,647,090 to Yang and 5,648,083 to Blieszner disclose additional personal care compositions and devices.

While these devices fulfill their respective, particular objective and requirements, the aforementioned patents do not describe a cleaning device for the anus for allowing a person to effectively clean themselves after a bowel movement.

In this respect, the cleaning device for the anus according to the present invention substantially departs from the conventional concepts and designs of the prior art, and in doing so provides an apparatus primarily developed for the purpose of allowing a person to effectively clean themselves after a bowel movement.

Therefore, it can be appreciated that there exists a continuing need for a new and improved cleaning device for the anus which can be used for allowing a person to effectively clean themselves after a bowel movement. In this regard, the present invention substantially fulfills this need.

SUMMARY OF THE INVENTION

In the view of the foregoing disadvantages inherent in the known types of personal hygiene devices now present in the prior art, the present invention provides an improved cleaning device for the anus. As such, the general purpose of the present invention, which will be described subsequently in greater detail, is to provide a new and improved cleaning device for the anus which has all the advantages of the prior art and none of the disadvantages.

To attain this, the present invention essentially comprises a cylindrical portion comprised of a flexible material. The cylindrical portion has an open upper end, a closed lower end, and a cylindrical side wall therebetween. The closed lower end is concave defining a central alignment point.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved cleaning device for the anus which has all the advantages of the prior art personal hygiene devices and none of the disadvantages.

It is another object of the present invention to provide a new and improved cleaning device for the anus which may be easily and efficiently manufactured and marketed.

It is a further object of the present invention to provide a new and improved cleaning device for the anus which is of durable and reliable construction.

An even further object of the present invention is to provide a new and improved cleaning device for the anus which is susceptible of a low cost of manufacture with regard to both materials and labor, and which accordingly is then susceptible of low prices of sale to the consuming public, thereby making such a cleaning device for the anus economically available to the buying public.

Even still another object of the present invention is to provide a new and improved cleaning device for the anus for allowing a person to effectively clean themselves after a bowel movement.

Lastly, it is an object of the present invention to provide a new and improved cleaning device for the anus including a cylindrical portion comprised of a flexible material. The cylindrical portion has an open upper end, a closed lower end, and a cylindrical side wall therebetween. The closed lower end is concave defining a central alignment point.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 2:
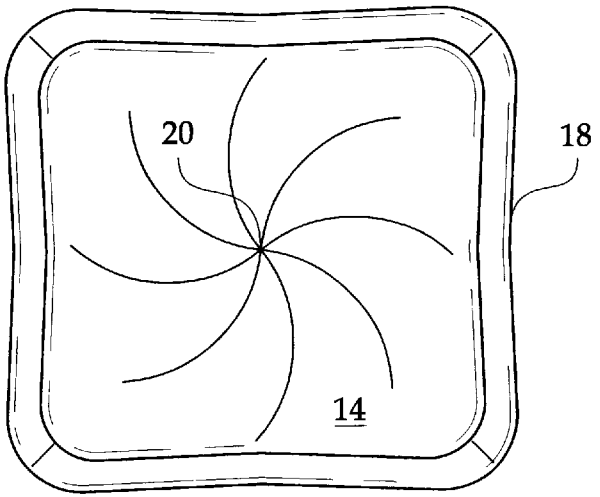
FIG. 2 is a top plan view of the present invention.
Figure 1:
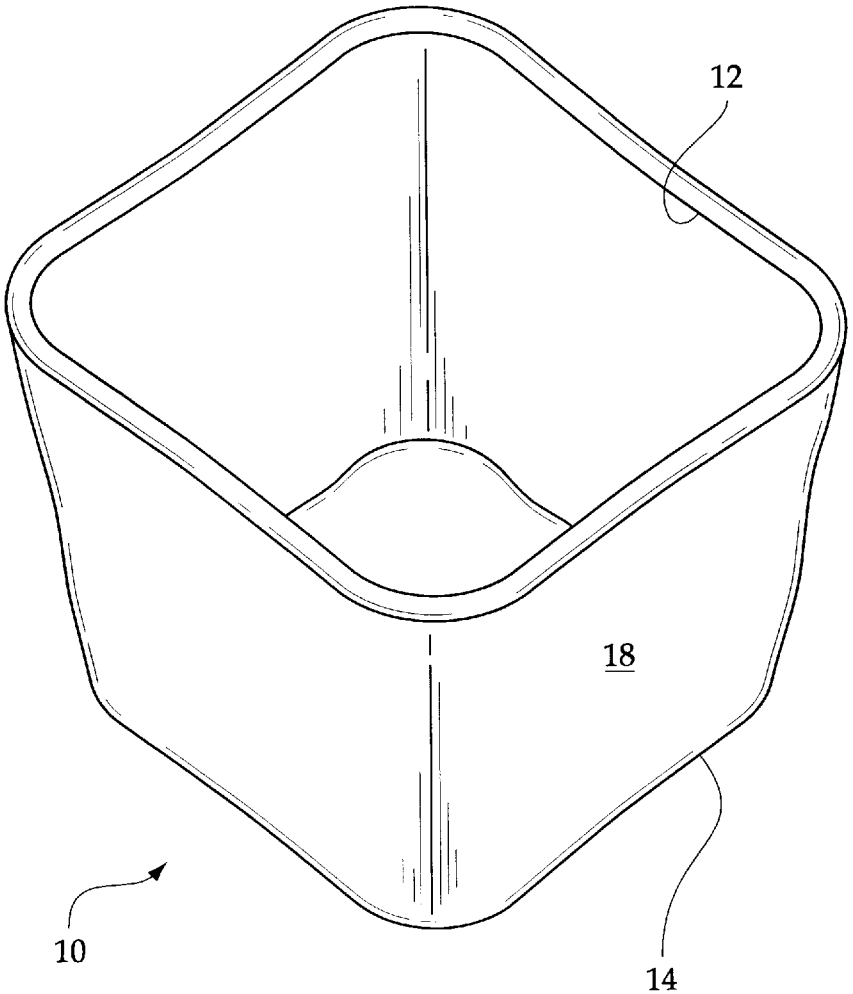
FIG. 1 is a perspective view of the preferred embodiment of the cleaning device for the anus constructed in accordance with the principles of the present invention.
Figure 3:
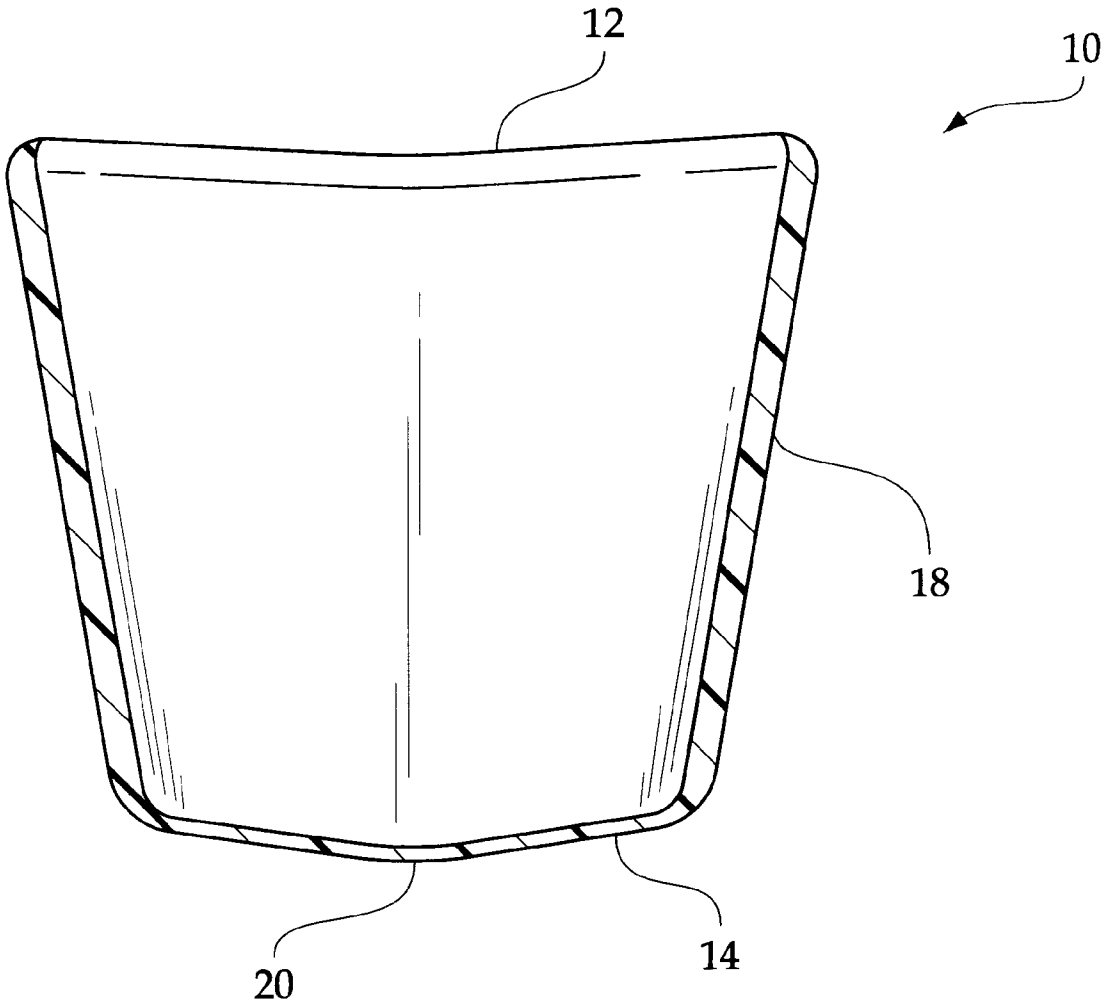
FIG. 3 is a cross-sectional side view of the present invention.

With reference now to the drawings, and in particular, to FIGS. 1 through three thereof, the preferred embodiment of the new and improved cleaning device for the anus embodying the principles and concepts of the present invention and generally designated by the reference number 10 will be described.

Specifically, it will be noted in the various Figures that the device relates to a cleaning device for the anus for allowing a person to effectively clean themselves after a bowel movement.

The present invention is essentially comprised of a cylindrical portion 10. The cylindrical portion 10 comprises a flexible material. The flexible material used can be selected from paper or flexible plastic. The materials noted are merely illustrative of the myriad of flexible materials that could be implemented. The cylindrical portion 10 has an open upper end 12, a closed lower end 14, and a cylindrical side wall 18 therebetween. The closed lower end 14 is concave defining a central alignment point 20.

The present invention is used to help clean one's bottom after using the bathroom. It is a small cup-like device that fits the contour of the bottom. To use, position the open upper end 12 over the anus after a bowel movement with the open upper end 12 in contact with the user surrounding the anus. Next, align the central alignment point 20 with the anus. Wipe the cylindrical portion 10 away from the anus, capturing the waste. Squeeze the cylindrical side wall 18 together to contain the waste within the cylindrical portion 12. Lastly, deposit the cylindrical portion 12 in a receptacle, such as a toilet.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A method of cleaning the anus using a cleaning device for allowing a person to effectively clean himself or herself after a bowel movement, the cleaning device comprising a cylindrical portion comprised of a flexible material, the cylindrical portion having an open upper end, a closed lower end, and a cylindrical side wall therebetween, the closed lower end being concave defining a central alignment point, comprising the steps of:

positioning the open upper end over the anus after a bowel movement with the open upper end in contact with the user and surrounding the anus;

aligning the central alignment point with the anus;

wiping the cylindrical portion away from the anus and capturing the waste;

squeezing the cylindrical side wall together to contain the waste within the cylindrical portion; and depositing the cylindrical portion in a receptacle.

* * * * *